US011319497B2

(12) United States Patent
Mykytiuk

(10) Patent No.: US 11,319,497 B2
(45) Date of Patent: May 3, 2022

(54) METHOD FOR PURIFYING LIQUID HYDROCARBON MOTOR FUELS FROM SULFUR AND FOR FURTHER REDUCING THE SULFUR DIOXIDE CONTENT IN EXHAUST GASES UP TO ZERO DURING COMBUSTION OF THE FUELS

(71) Applicant: Unique Equipment Solutions LLC, Littleton, MA (US)

(72) Inventor: Oleksandr Yuriiovych Mykytiuk, Kyiv (UA)

(73) Assignee: Unique Equipment Solutions, LLC, Littleton, MA (US)

( * ) Notice: Subject to any disclaimer, the term of this patent is extended or adjusted under 35 U.S.C. 154(b) by 0 days.

(21) Appl. No.: 16/962,038

(22) PCT Filed: Jan. 15, 2019

(86) PCT No.: PCT/UA2019/000005
§ 371 (c)(1),
(2) Date: Jul. 14, 2020

(87) PCT Pub. No.: WO2019/139558
PCT Pub. Date: Jul. 18, 2019

(65) Prior Publication Data

US 2020/0400054 A1 Dec. 24, 2020

(30) Foreign Application Priority Data

Jan. 15, 2018 (UA) ..... a 2018 00404

(51) Int. Cl.
*C10G 53/14* (2006.01)
*C10G 53/00* (2006.01)
*C10G 27/12* (2006.01)

(52) U.S. Cl.
CPC ..... *C10G 53/14* (2013.01); *C10G 27/12* (2013.01); *C10G 53/00* (2013.01); *C10G 2300/202* (2013.01)

(58) Field of Classification Search
CPC .. C10G 27/00–14; C10G 29/16; C10G 31/06; C10G 53/14
See application file for complete search history.

(56) References Cited

U.S. PATENT DOCUMENTS

2006/0081501 A1* 4/2006 Kozyuk ..... C10G 27/12 208/208 R

FOREIGN PATENT DOCUMENTS

| | | | |
|---|---|---|---|
| RU | 2270850 | C1 | 2/2006 |
| RU | 2359992 | C2 | 6/2009 |
| UA | 6153 | | 4/2005 |
| UA | 75259 | C2 | 3/2006 |
| WO | 2006044041 | A2 | 4/2006 |

OTHER PUBLICATIONS

Burtnaya et al., "Membrane technology for removal of sulfur compounds from diesel fuel", Chemistry and Technology of Fuels and Oils, 2008, vol. 44, Is. 5, pp. 291-294.
Sagin et al., "Use of ultrasonic treatment to reduce fuel sulfur engine wear", XXXV International Scientific and Practical Conference "Technical Sciences—From Theory To Practice", Novosibirsk: SibAC, 2014, No. 6(31), pp. 42-48.

* cited by examiner

*Primary Examiner* — Renee Robinson
(74) *Attorney, Agent, or Firm* — Loginov & Associates, PLLC; William A. Loginov

(57) ABSTRACT

The invention relates to the oil-refining industry, in particular, to methods for purifying a fuel from sulfur-containing compounds, by separating the sulfur-containing modified molecules from the remainder of the fuel molecules on polymer membranes and by activating the fuel purified in the fully-developed cavitation mode prior to the combustion. The reduction of the sulfur content in the fuel is achieved by treating the fuel or a fuel fraction in the fully-developed cavitation mode with addition of a hydrogen peroxide aqueous solution and/or a strong aqueous solution of iron oxides, followed by separating the obtained emulsion into a fuel fraction and a water-paraffin emulsion, followed by separating the fuel fraction on the membranes under the temperature of from 90° C. to 180° C. under atmospheric pressure into a fuel fraction having low sulfur combustion of the purified fuels down to zero by means of activation of the fuels having the low sulfur content.

2 Claims, No Drawings

METHOD FOR PURIFYING LIQUID HYDROCARBON MOTOR FUELS FROM SULFUR AND FOR FURTHER REDUCING THE SULFUR DIOXIDE CONTENT IN EXHAUST GASES UP TO ZERO DURING COMBUSTION OF THE FUELS

FIELD OF THE INVENTION

The invention relates to the oil-refining industry, in particular, to methods for purifying a fuel from sulfur-containing compounds.

BACKGROUND OF THE INVENTION

"A method for purifying oil and oil products from sulfur compounds" that comprises treating the oil or oil products with an irrigation liquid, the method characterized in that the oil and oil products are preliminary treated with a streamer electric discharge, is known. The liquid is fed for treatment under the pressure of 2-3 MPa at the irrigation path l=(5 . . . 6) a, wherein l is a length of the irrigation path, a is a distance between nozzles for spraying the irrigation liquid (Ukrainian patent No. 6153 as of 15 Apr. 2005).

A drawback of the method lies in complexity of its implementation.

The method that is the closest to the claimed invention is "A method for purifying diesel fuel from sulfur-containing compounds" that comprises mixing the diesel fuel with chemical substances followed by separation and reduction of the reagents, according to the invention, the diesel fuel is mixed with triethylamine; the obtained mixture is separated using polymer membranes by the pervaporation method to form two technological streams of the purified diesel fuel and a mixture of the triethylamine with the removed sulfur-containing compounds, the second flow is mixed with dimethylsulfoxide and the obtained mixture is separated by the pervaporation method up to complete removal of triethylamine, and the obtained remainder in the form of dimethylsulfoxide and sulphur compounds is mixed with water, and reagents and the removed sulphur-containing compounds are separated, wherein the separated triethylamine, dimethylsulfoxide and water are delivered for the repeated use in the closed circuit (Ukrainian patent No. 75259 as of 15 Mar. 2006).

A drawback of the closest method lies in that the method allows reduction of the sulfur-containing compounds content in the diesel fuel only and provides formation of wastes, which must be disinfected or stacked.

BRIEF SUMMARY OF THE INVENTION

The underlying problem of the invention is to develop a method that could enable reduction of the sulfur content in liquid hydrocarbon motor fuels such as petrol, kerosene and diesel fuel up to the level of 20 ppm (parts per million being a measuring unit of a concentration) or less and reduction of the sulfur dioxide concentration in exhaust gases during combustion of these fuels.

DETAILED DESCRIPTION OF THE INVENTION

The stated problem is solved by the method for purifying liquid hydrocarbon motor fuels from sulfur and for further reducing the sulfur dioxide content in exhaust gases up to zero during combustion of the fuels by modifying the sulfur-containing fuel molecules in a fully-developed cavitation mode, by separating the sulfur-containing modified molecules from the remainder of the fuel molecules on the polymer membranes and by activating the fuel purified up to 20 ppm in the fully-developed cavitation mode prior to the combustion. What is novel is that the reduction of the sulfur content in the fuel is achieved by means of treating the fuel or a fuel fraction in the fully-developed cavitation mode with addition of a hydrogen peroxide aqueous solution and/or a strong aqueous solution of iron oxides to the fuels, followed by separating the obtained emulsion into a fuel fraction and a water-paraffin emulsion, followed by separating the fuel fraction on the membranes under the temperature of from 90° C. to 180° C. under the atmospheric pressure into a fuel fraction having a low sulfur content and a fuel fraction having an increased sulfur content. Reduction of the sulfur dioxide in the exhaust gases during combustion of the purified fuels up to zero by means of activation of the fuels having the low sulfur content in the fully-developed cavitation mode is performed without addition of other chemical substances. Production of a reduced oil-water emulsion from the water-paraffin emulsion and the fuel fraction having the increased sulfur content that increases the efficiency of reduced oils combustion is performed in boiler units. Reduction of the sulfur content in the fuel or fuel fractions is performed up to the required level of 20 ppm or less. Treatment of the initial fuel or fuel fraction by the cavitation is performed under the pressure of 1.0-5.0 atm and the temperature of 20° C.-70° C.

A method for purifying liquid hydrocarbon motor fuels from sulfur and for further reducing the sulfur dioxide content in exhaust gases up to zero is performed as follows. Reduction of the sulfur content in liquid hydrocarbon fuels or fuel fractions, including petrol, kerosene, diesel fuel, up to the required level of 20 ppm or less is achieved by means of treating the initial fuel or fuel fraction my mechanical, ultrasound or electrospark cavitation under the pressure of 1.0-5.0 atm and the temperature of 20° C.-70° C. with addition, to the fuel or fuel fraction, of 1-10 ml of 3%-50% hydrogen peroxide aqueous solution and/or a strong aqueous solution of iron oxides having an own formula in the total amount of 0.5%-20% by the fuel volume, while the ratio between the hydrogen peroxide and iron oxides solutions is from 1:2 to 1:10, followed by separating the obtained emulsion into the fuel fraction and the water-paraffin emulsion, followed by separating the fuel fraction on the membranes, which are used for extracting the fuel fractions from a raw oil, under the temperature of up to 90° C. for purifying petrol, up to 120° C. for purifying kerosene and up to 180° C. for purifying diesel fuel under the atmospheric pressure, into the fuel fraction having a low sulfur content with the fraction yield of up to 95% by the volume of the incoming fuel, and into the fuel fraction having an increased sulfur content (the remainder). The obtained water-paraffin emulsion and the fuel fraction having the increased sulfur content is used for producing the reduced oil-water emulsion for increasing the efficiency of combustion of the reduced oils in boiler units and for reducing emissions of harmful and greenhouse gases. The obtained fuel fraction having the sulfur content of 20 ppm or less is treated by the mechanical cavitation without addition of other substances that allows reduction of the sulfur level in the exhaust gases of the internal combustion engines and boiler units up to zero in case an activated fuel is used during five days after treatment.

Reduction of the sulfur content in the motor fuels, including petrol, kerosene, diesel fuel, is achieved by means of:

partial targeted oxidation of the sulfur-containing compounds, which are comprised in the fuels, by the hydrogen peroxide, bonding of the sulfur with the iron, destroying the sulfur compounds with the hydrocarbon molecules, which are permeable for membranes being used, and formation of the sulfur compounds in the fuel, which do not penetrate through the membranes in the process of the cavitation treatment of the mixture; partial bonding of the sulfur with the iron in the process of the cavitation treatment of the mixture; destroying the sulfur compounds with the hydrocarbon molecules, which are permeable for the membranes being used, and formation of the sulfur compounds, which do not penetrate through the membranes, during the cavitation treatment with addition of the hydrogen peroxide and iron oxides in the fuel; conversion of the sulfur-containing hydrocarbon compounds into the sulfur compounds with oxygen and/or with iron in the process of the cavitation treatment of the mixture without addition of chemical substances; reduction of the sulfur content in the exhaust gases up to zero due to the treatment of the preliminary purified fuel by the mechanical cavitation and consuming the fuel during 14 days after the fuel treatment.

The claimed method reduced the sulfur content in liquid hydrocarbon fuels or fuel fractions, including petrol, kerosene, diesel fuel, up to the required level of 20 ppm or less, and reduced the sulfur dioxide content in the exhaust gases up to zero under the condition of consuming the fuel during five days after fuel activation. The reduced oil-water emulsion for increasing the efficiency of reduced oils combustion in the boiler units is produced from the wastes formed in the treatment process.

The invention claimed is:

1. A method for purifying liquid hydrocarbon motor fuels by reduction of a sulfur content and for further reducing a sulfur dioxide content in exhaust gases down to zero during combustion of the fuels by means of chemical transformation of sulfur-containing molecules of the fuels in a fully-developed cavitation mode, physical separation of modified sulfur-containing molecules from the remainder of the molecules on membranes followed by activation of the fuels in the fully-developed cavitation mode prior to the combustion, characterized in that the reduction of the sulfur content in the fuel comprises the steps of:

treating the fuel or fuel fraction in the fully-developed cavitation mode with addition, to the fuel, of a hydrogen peroxide aqueous solution in the amount of 1-10 ml of the hydrogen peroxide per 1 liter of the fuel and/or an aqueous solution of iron oxides in the amount of 0.5%-20% of the fuel volume, followed by;

separating an obtained emulsion into a fuel fraction and a water-paraffin emulsion, and followed by;

separating the fuel fraction on the membranes under a temperature of from 90° C. to 180° C. under the atmospheric pressure into a fuel fraction having a low sulfur content of up to 20 ppm and into a fuel fraction having an increased sulfur content, including reduction of the sulfur dioxide content down to zero in the exhaust gases by means of activation prior to the combustion of the fuel fraction having the low sulfur content in the fully-developed cavitation mode without addition of other chemical substances, production of a reduced oil-water emulsion from the water-paraffin emulsion and the fuel fraction having the increased sulfur content for combustion in boiler units.

2. The method of claim 1, characterized in that wastes, which must be disinfected or stacked, are not formed during the method of purifying the fuels.

* * * * *